United States Patent [19]

Ohnuma

[11] Patent Number: 4,728,312

[45] Date of Patent: Mar. 1, 1988

[54] LIFT DEVICE FOR TOY TRACK WAY

[75] Inventor: Nobuyoshi Ohnuma, Tokyo, Japan

[73] Assignee: Tomy Kogyo Co., Inc., Tokyo, Japan

[21] Appl. No.: 21,211

[22] Filed: Mar. 3, 1987

[30] Foreign Application Priority Data

May 9, 1986 [JP] Japan ..... 61-69611

[51] Int. Cl.[4] ..... A63H 11/04

[52] U.S. Cl. ..... 446/314

[58] Field of Search ..... 446/171, 168, 169, 314, 446/444, 172, 424

[56] References Cited

U.S. PATENT DOCUMENTS 2,013,568 9/1935 Mallard ..... 446/314

3,721,036 3/1973 Goldfarb ..... 446/314

FOREIGN PATENT DOCUMENTS 468002 11/1928 Fed. Rep. of Germany ..... 446/314

*Primary Examiner*—Mickey Yu

*Attorney, Agent, or Firm*—Staas & Halsey

[57] ABSTRACT

An endless toy track way is described, including a lift device; a rail connected at its ends to the lift device; and a moving body which rolls via gravity on the rail and is lifted by the lift device. The lift device includes a pair of parallel, spaced, fixed stairs and a pair of vertically movable plates formed with engaging steps at their upper edges and being arranged longitudinally inside of the pair of fixed stairs. This pair of vertically movable plates is engaged with cams of a driving mechanism to cause the movable plates to alternately move in circular paths and ascend and descend. The moving body is provided at both lower sides thereof with projections which are engageable with the engaging steps of the vertically movable plates so that the moving body is carried onto succeeding stairs of the fixed stairs, one after the other.

5 Claims, 5 Drawing Figures

LIFT DEVICE FOR TOY TRACK WAY

BACKGROUND OF THE INVENTION

This invention relates to a toy track way and, more particularly, to an endless toy track way including a lift device and at least one moving body which is both lifted by the lift device and rolls on a rail via gravity.

Toy track ways are well known to include a moving body having no means of self-propulsion but being capable of travelling on a rail connected to a lift device. Generally, the moving body is lifted in a manner similar to an escalator, i.e., by driving an endless belt which is provided with engageable projections for holding the moving body.

On the other hand, Japanese Published Application No. 53-50558 discloses a device wherein a moving body is moved up a set of fixed stairs. In this device, at an intermediate portion of the fixed stairs there is arranged a movable stair which moves up and down. The movable stair moves up a particular height to the next fixed stair and then moves forward horizontally to carry the moving body onto this next fixed stair.

Though the above-mentioned conventional lift devices function relatively well to transfer a moving body, such as a doll, the manner of transferring the body appears so mechanical that the toy's amusement value is lessened, particularly when the transferred body is a doll or animal toy. The present invention solves the foregoing problem.

SUMMARY OF THE INVENTION

Accordingly, it is an object of the present invention to provide a toy track way capable of transferring a moving body fluidly up stairs to heighten the amusement value of the toy and increase the user's interest therein.

To achieve the foregoing and other objects of the present invention and in accordance with the purposes of the invention there is provided a toy track way having a lift device with fixed stairs at both sides thereof and a pair of vertically movable plates having engageable steps at their upper edges and being disposed along the inner sides of the fixed stairs. This pair of vertically movable plates engages with cams mounted on a drive shaft of a drive mechanism to cause alternating ascending and descending actions of the movable plates. A moving body is also included, having at both sides of its lower end, leg-shaped projections which are engageable with the vertically moveable plates so that the leg-shaped projections are alternately carried upward onto succeeding stairs of the fixed stairs, giving the impression that the moving body is actually walking up the fixed stairs.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

The preferred embodiments of the present invention will now be described with reference to FIGS. 1–5.

Figure 1:
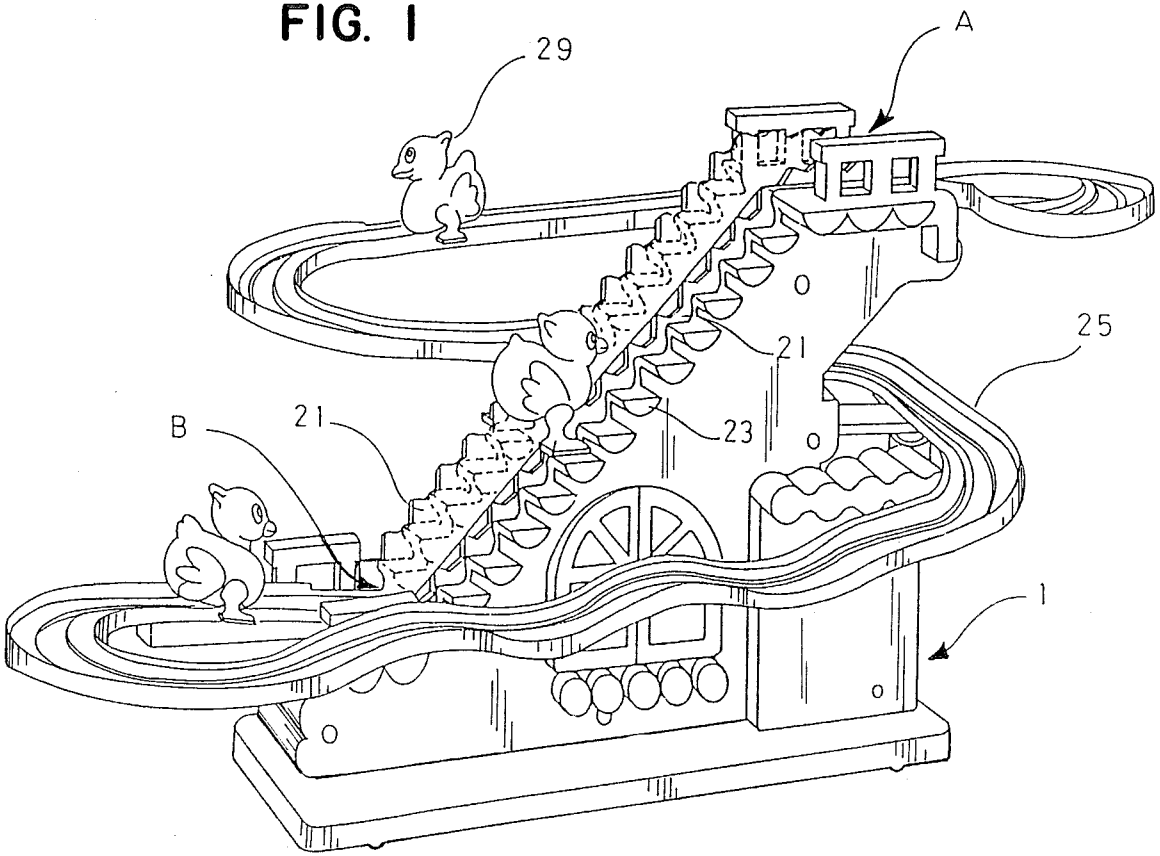
FIG. 1 is a perspective view of the toy track way according to the present invention, illustrating particularly the lift device and rail connected thereto.

In FIG. 1, reference number 1 denotes a lift device which is connected at its uppermost portion A and lowermost portion B to the ends of a rail 25. Together, the lift device 1 and rail 25 constitute an endless track way.

Figure 2:
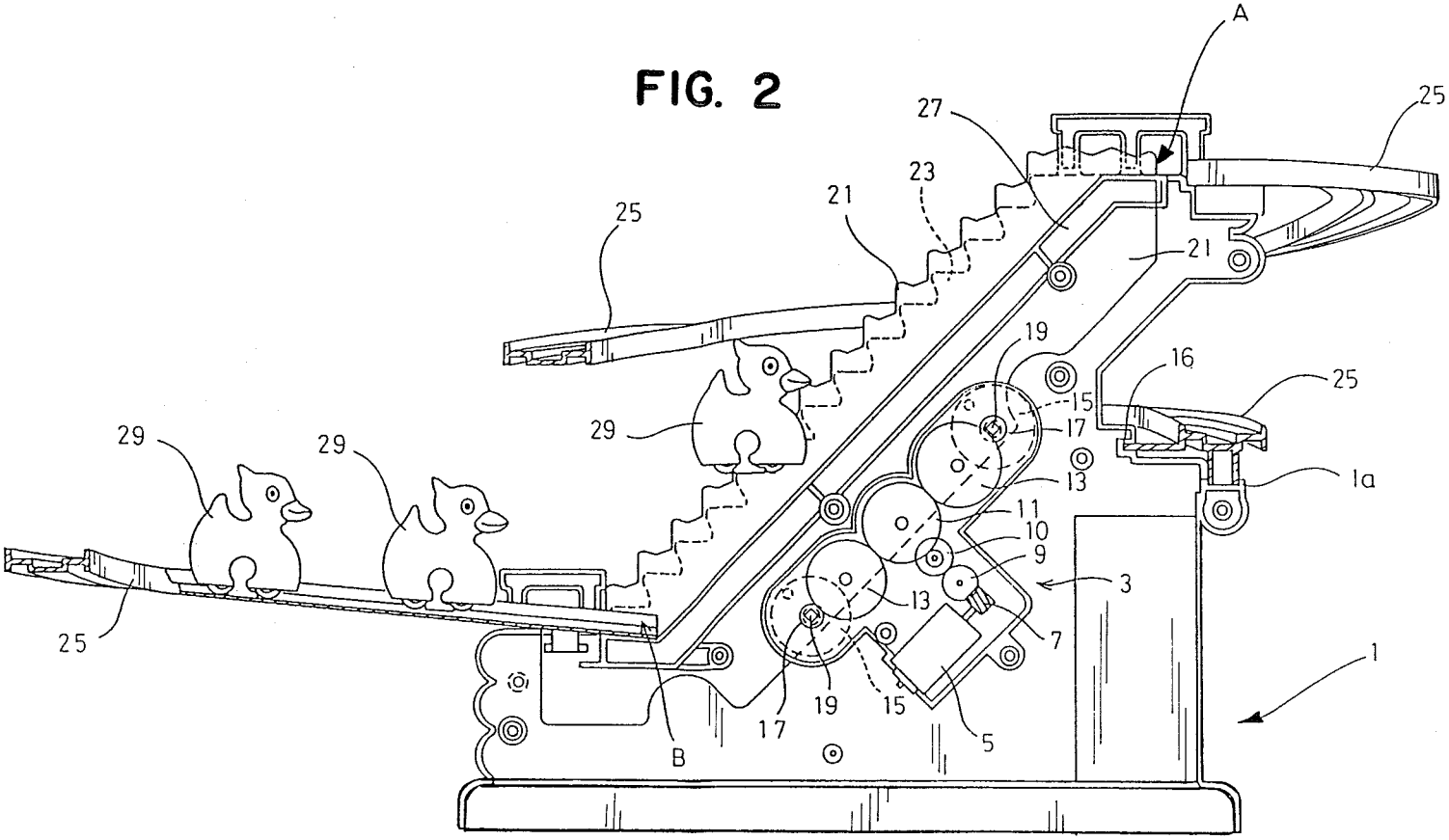
FIG. 2 is a right side, cross-sectional view of the drive means in the lift device.

As best seen in FIG. 2, fitting grooves 1*a* formed on the lift device 1 receive projections 16 extending from the rail 25 to support the rail 25, i.e., to prevent the rail 25 from bending at its intermediate portion.

On the lift device 1 there is provided a pair of parallel, spaced fixed stairs 23. The fixed stairs 23 receive leg-shaped projections 29*b* formed on the moving body 29, as described later, and are disposed in such a way that one stair on one of the fixed stairs 23 is positioned between two stairs arranged on the other fixed stair on the other side of the lift device 1 so that the moving body 29 is tilted right and left when going up the fixed stairs 23, as also described below.

Figure 3:
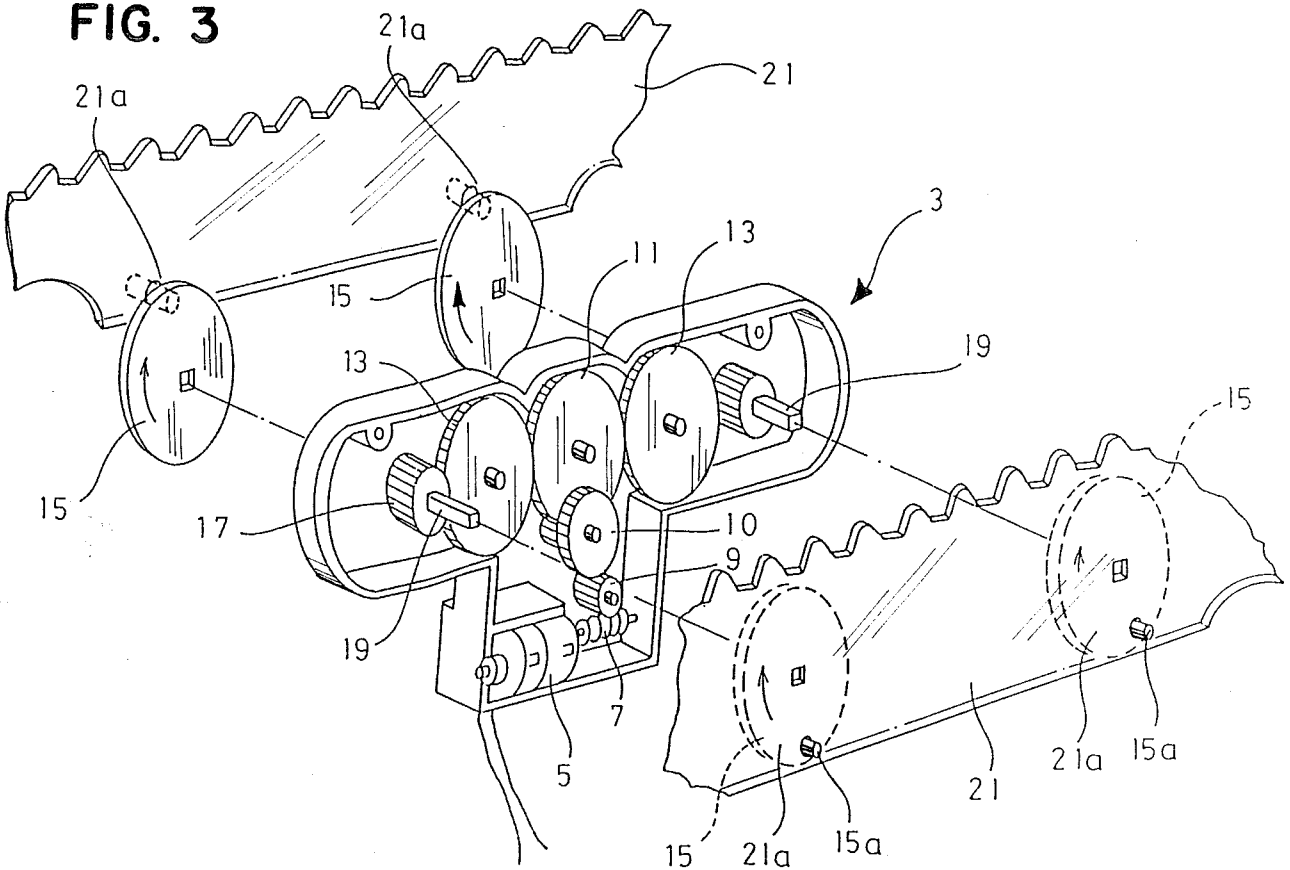
FIG. 3 is an exploded, perspective view of the drive means shown in FIG. 2.
Figure 4:
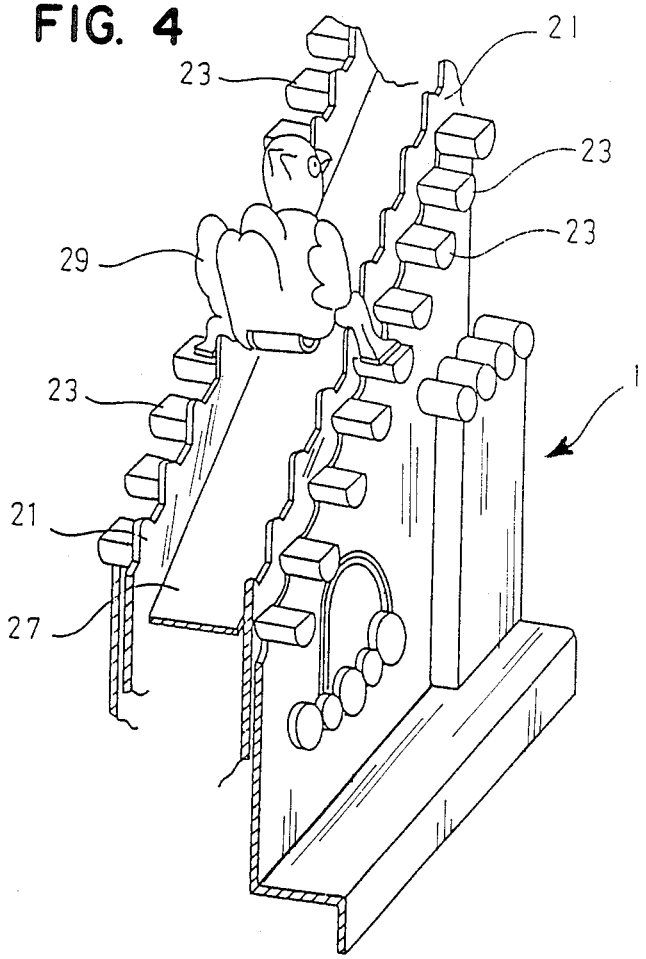
FIG. 4 is a perspective view showing a moving body on a portion of the lift device.

The lift device 1 will now be described in greater detail with reference to FIGS. 2 and 3. For better understanding, FIG. 2 shows a longitudinal cross-section of the lift device 1 and a drive means 3 with the cover removed and FIG. 3 shows the drive means 3, again without the cover.

The drive means 3 is fixed inside the lift device 1 by any appropriate means, such as screws. A motor 5 is connected to a conventional battery box (not shown) provided in the lift device 1 through an ON-OFF switch (not shown). The motor shaft receives a worm gear 7 which meshes with a worm wheel 9, which then meshes with an intermediate gear 10 to transmit the drive force to a transmission gear 11. The transmission gear 11 engages at both sides thereof gears 13, each of which engages a gear 17 mounted on a square shaft 19. The square shafts 19 extend through both sides of the drive means 3. The respective axes of the gears 11, 13 and 17 are preferably coplanar.

On each end of each square shaft 19 a disk 15 is mounted. Each disk 15 is provided with a pin 15*a* mounted near its edge. The pin 15*a* at one end of each square shaft 19 is positioned 180 degrees out of phase relative to the pin 15*a* at the other end of the same shaft 19. Each disk 15 and pin 15*a* combination functions as a cam. Alternatively, a cam-shaped projection may be attached to the disks 15 in place of the pin 15*a*.

Two parallel, vertically movable plates 21 are arranged between the pair of parallel, spaced fixed stairs 23. Further, a ramp 27 is positioned on the lift device 1 between the pair of plates 21. Each plate 21 is formed to include a series of sawtooth-shaped engaging steps at the upper edge. The pins 15*a* provided on the disks 15 are fitted through holes 21*a* formed near the lower edge of each vertically movable plate 21.

Figure 5:
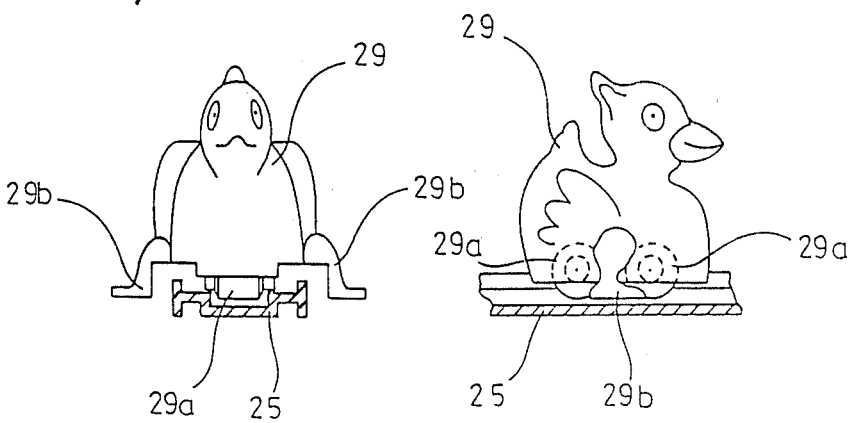
FIG. 5 includes partial cross-sectional views showing the moving body from the front and right side, respectively, travelling on the rail.

FIG. 5 shows the moving body 29 formed in a shape of a bird moving on the rail 25 by means of a pair of rollers 29*a*. As the moving body 29 moves along the rail, the rollers 29*a* are disposed in the center groove of the rail 25 to hold the moving body 29 on the rail 25.

Operation of the toy track way will now be described.

When the moving body 29 is at the uppermost portion A of the lift device 1, i.e., at the beginning of the rail 25, the moving body 29 moves down the rail 25 by gravity via the rollers 29*a*. When the moving body 29 reaches the lowermost portion B of the lift device 1, i.e., the end of the rail 25, the leg-shaped projections 29*b* are alternately carried up onto the fixed stairs 23.

More particularly, as the motor 5 rotates, the four disks 15 rotate in the direction of the arrows shown in FIG. 3, which causes both of the vertically movable plates 21 to make circular motions via the pins 15*a* fitted through the holes 21*a*. As a result of these circular motions of the vertically movable plates 21 relative to the fixed stairs 23, an engaging, step of the vertically movable plate 21 positioned below an adjacent stair of the fixed stairs 23 moves upward and forward relative to the adjacent fixed stair, reaches the next fixed stair, and then goes down below the upper surface of this next fixed stair to return to its original position. Thus, when the moving body 29 is on the fixed stairs 23 at lowermost portion B, one of the leg-shaped projections 29*b* thereof is moved up onto the next fixed stair by this moving plate 21 action. Then, the other projection 29*b* is advanced, and so on until the moving body arrives at the uppermost portion A to start the cycle over again.

Accordingly, the moving body 29 simulates fluid, step-by-step movement on the fixed stairs 23 of the lift device 1. As this action looks like a doll, child or an animal toddling along, a highly amusing toy track way is provided.

The foregoing is considered illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to, falling within the scope of the invention and the appended claims.

I claim:

1. An endless toy track way, comprising:

(a) a rail having a first end and a second end, the second end being elevated relative to the first end;

(b) a moving body provided for movement via gravity on the rail and having a pair of lateral projections; and (c) a lift device, including (i) a pair of parallel, spaced, fixed stairs, (ii) first and second vertically, movable plates formed with engaging steps at one edge thereof and arranged longitudinally inside the pair of fixed stairs, and (iii) drive means operatively connected to the first and second movable plates, wherein, the first and second vertically movable plates are each moved by the drive means to ascend and descend alternatively, and wherein said projections of the moving body are engaged with the engaging steps of the first and second vertically movable plates so that the moving body is carried onto each succeeding stair of the pair of fixed stairs, one projection after the other.

2. The track way as recited in claim 1, wherein the drive means comprises:

(i) a motor with a first shaft, (ii) a gear train operatively connected to the first shaft, (iii) a pair of second shafts connected to said gear train, (iv) a disk mounted at each end of each second shaft, and (v) cam means operatively connected between the disks and the first and second movable plates.

3. The track way as recited in claim 2, wherein the cam means comprises:

(i) a pin formed on each disk such that the pins formed on one pair of disks on one respective side of the second shafts are out of phase with the pins formed on the other pair of disks on the other respective side of the second shafts, and (ii) holes formed in the first and second vertically, movable plates to receive the corresponding pins.

4. The track way as recited in claim 3, wherein the gear train comprises:

(i) a first worm gear mounted to the first shaft, (ii) a worm wheel meshing with the first worm gear, (iii) a second gear meshing with the worm wheel, (iv) a third gear meshing with the second gear, (v) a pair of fourth gears meshing with the third gear, and (vi) a pair of fifth gears each mounted on one of the second shafts and meshing with the fourth gears.

5. An endless toy track way, comprising:

(a) a rail having a first end and a second end, the second end being elevated relative to the first end;

(b) a moving body provided with a roller to roll on the rail via gravity and a pair of lateral projections; and (c) a lift device, including (i) a pair of parallel, spaced, fixed stairs, (ii) first and second, parallel vertically movable plates formed with engaging steps at one edge thereof and arranged longitudinally inside the pair of fixed stairs, and (iii) drive means operatively connected to the first and second vertically, movable plates, the drive means including a motor with a first shaft, a gear train operatively connected to the first shaft, a pair of second shafts connected to the gear train, a disk mounted at each end of each second shaft, and cam means operatively connected between the disks and the first and second movable plates, wherein, each of the first and second vertically, movable plates is moved in a circular path by the drive means to ascend and descend alternatively, and wherein the projections of the moving body are each alternately engaged with an engaging step of each of the first and second vertically movable plates so that the moving body is carried onto each succeeding stair of the fixed stairs, one projection after the other.

* * * * *